US005328385A

United States Patent [19]

Cheu

[11] Patent Number: 5,328,385

[45] Date of Patent: Jul. 12, 1994

[54] LAMP SOCKET

[76] Inventor: Tseng-Fan Cheu, No. 24, Shing Shye Street, Hsinchu City, Taiwan

[21] Appl. No.: 101,732

[22] Filed: Aug. 4, 1993

[51] Int. Cl.[5] ..... H01R 13/00

[52] U.S. Cl. ..... 439/425

[58] Field of Search ..... 439/389–425

[56] References Cited

U.S. PATENT DOCUMENTS

| | | | |
|---|---|---|---|
| 1,745,133 | 1/1930 | Wermine | 439/425 |
| 2,749,527 | 6/1956 | Gast | 439/425 |
| 3,127,229 | 3/1964 | Beck | 439/425 |

*Primary Examiner*—Joseph H. McGlynn

*Attorney, Agent, or Firm*—Varndell Legal Group

[57] ABSTRACT

A lamp socket which includes a socket cap fastened to a socket shell by hook to carry a hot wire and a neutral wires, ring contact fastened inside the socket shell to hold the ring contact of a lamp bulb and having a tip inserted through a slot on the socket shell and pierced through the neutral wire to make an electric contact, a tip contact having one end inserted through another slot on the socket shell and connected to the tip contact of the lamp bulb and an opposite end pierced into the hot wire to make an electric contact.

1 Claim, 4 Drawing Sheets

LAMP SOCKET

BACKGROUND AND SUMMARY OF THE INVENTION

The present invention relates to lamp sockets, and more particularly to a simple structure of lamp socket which is easy to assemble.

A normal decoration lamp for a Christmas light set, as shown in FIG. 1, is generally comprised of a lamp socket to hold a bulb. The lamp socket is comprised of a ring contact connected to the negative terminal of the bulb, a tip contact separated from the ring contact by an insulator and connected to the positive terminal of the bulb, two conductors respectively connected to the ring contact and the tip contact, a socket shell and a socket cap (not shown) covered over the ring contact and the tip contact. This structure of lamp socket is complicated to manufacture. When making a Christmas light set by connecting a plurality of lamp sockets of the aforesaid structure in parallel, a complicated electric circuit is needed.

The present invention eliminates the aforesaid drawbacks. It is therefore the principal object of the present invention to proivde a lamp socket which is easy to manufacture. It is another object of the present inventin to proivde a lmap socket which can be conveniently connected to other lamp sockets of the same structure in parallel to set up a Christmas light set.

DETAILED DESCRIPTION OF THE PREFERRED EMBODIMENT

Figure 1:
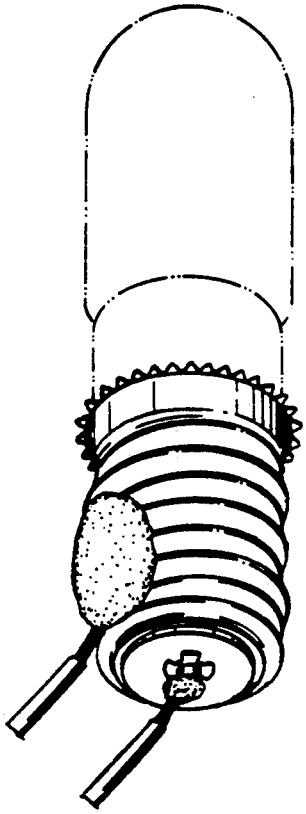
Fig. 1 PRIOR ART
FIG. 1 illustrates the lamp socket for a decoration lamp according to the prior art (the socket shell and the socket cap are removed).
Figure 2:
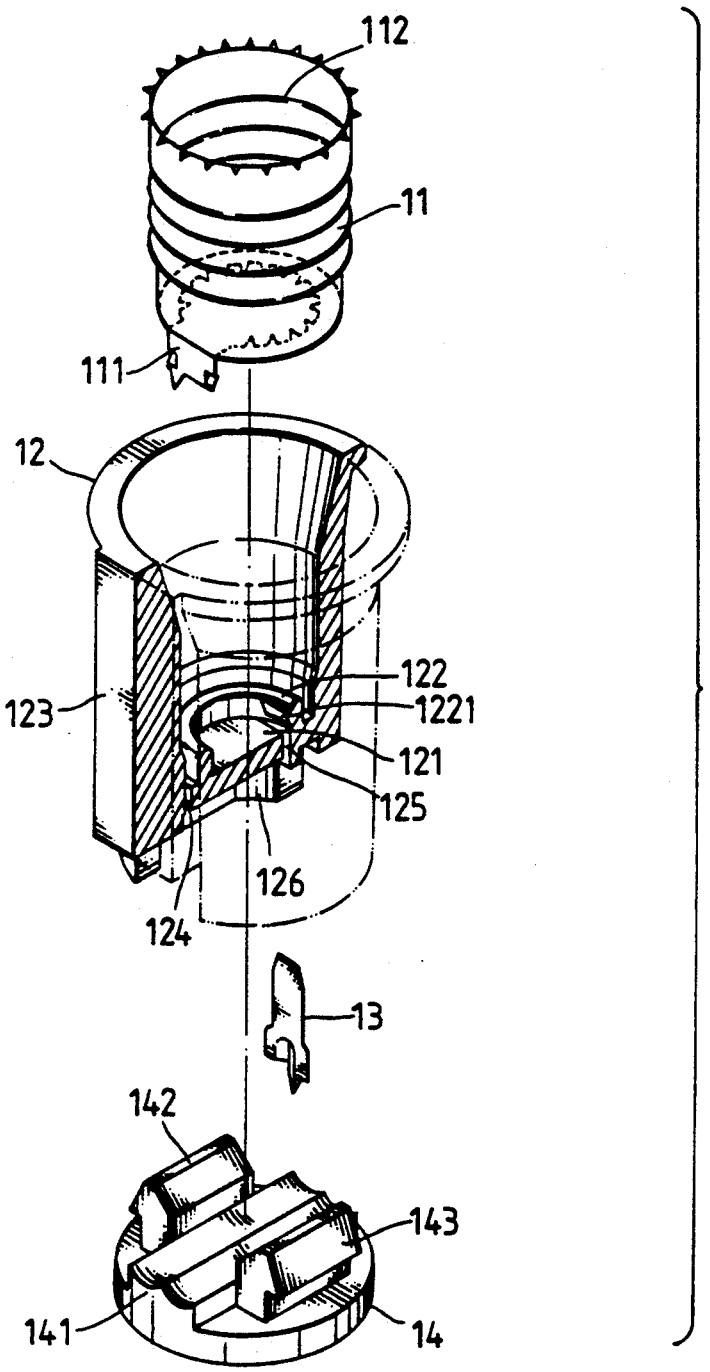
FIG. 2 is a perspective exploded view of a lamp socket according to the present invention.
Figure 3:
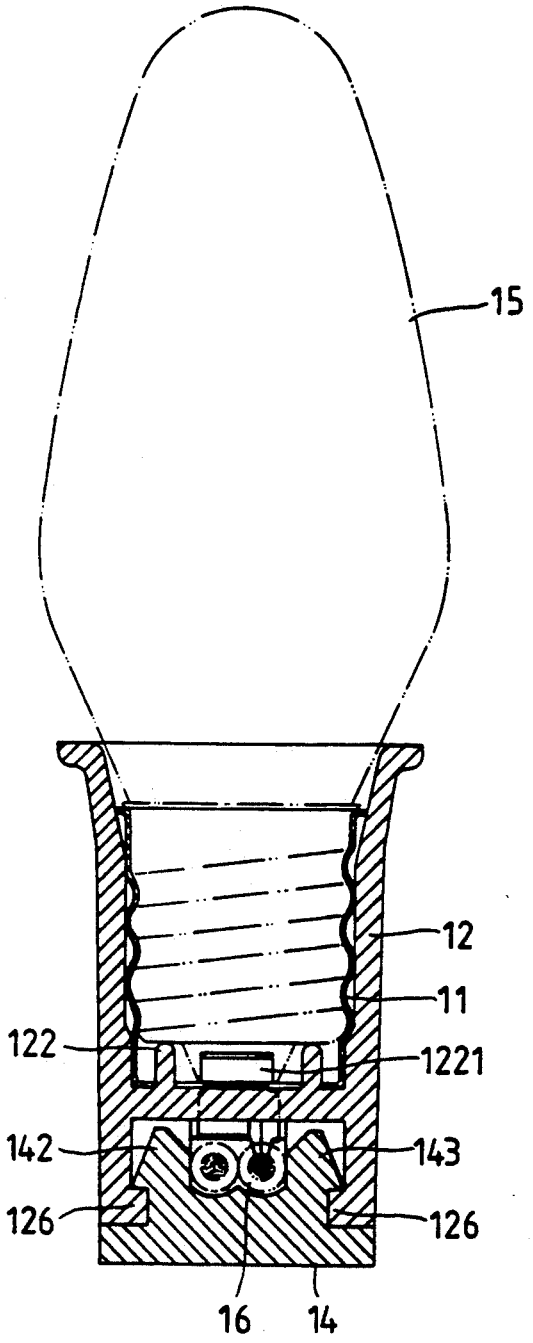
FIG. 3 is a sectional assembly view of the lamp socket shown in FIG. 2.
Figure 4:
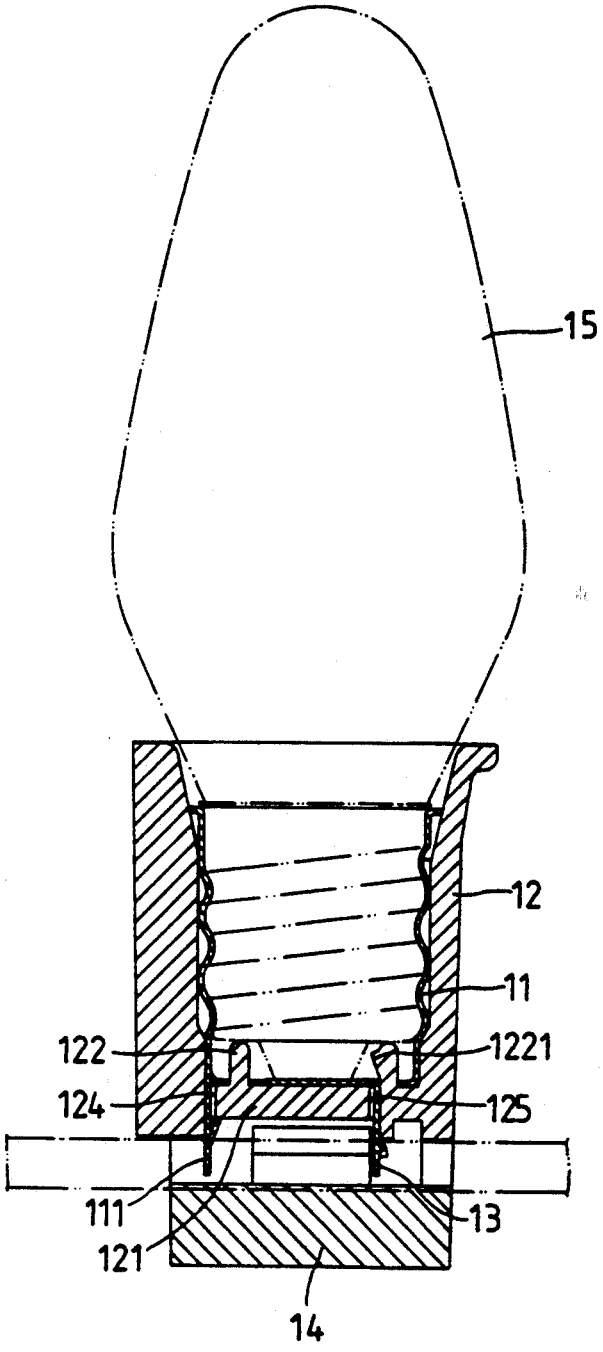
FIG. 4 is another sectional assembly view of the lamp socket shown in FIG. 2 taken from another side.

Referring to FIGS. 2, 3, and 4, a lamp socket in accordance with the present invention is generally comprised of a socket shell 12, a ring contact 11 received within the socket shell 12 to hold a lmap bulb 15, and a socket cap 14 fastened to the socket shell 12 at the bottom.

The socket shell 12 comprises an inside annular flange 122 upstanding from a horizontal bottom wall 121 thereof and spaced from a vertical side rib 123 thereof, a bottom flange 126 projected downwards from the horizontal bottom wall 121, a first slot 124 through the horizontal bottom wall 121 between the inside annular flange 122 and the vertical rib 123, a second slot 125 through the horizontal bottom wall 121 within the inside sloping surface 1221 of the inside annular flange 122.

The socket cap 14 comprises a double-groove block 141 to carry two electric wires 16 (the hot wire and the neutral wire), and two opposite hooks 142; 143 separated by the double-groove block 141 and respectively hooked on the bottom flange 126 of the socket shell 12.

The ring contact 11 comprises a spiral groove 112 around the inside wall thereof, which receives the ring contact of the lamp bulb 15, and a notched tip 111 inserted through the first slot 124 and pierced into the respective electric wire 16 to make an electric contact.

The tip contact 13 has a top end supported on the inside sloping surface 1221 of the inside annular flange 122 and connected to the tip contact of the lamp bulb 15, and a bottom end inserted through the second slot 125 and pierced into the respective electric wire 16 to make an electric contact.

As indicated, the lamp socket is convenient to assemble. As the socket cap 14 is fastened to the socket shell 11 with the electric wires 16 retained therebetween, the tip 111 of the ring contact 11 and the wires 16 and electrically connected to the conductor of the repsetive electric wire 16.

I claim:

1. A lamp socket comprising:

a socket shell, said socket shell comprising an inside annular flange upstanding from a horizontal bottom wall thereof and spaced from a vertical side rib thereof, a bottom flange projected downwards from said horizontal bottom wall, a first slot through said horizontal bottom wall between said inside annular flange and said vertical said rib, a second slot through said horizontal bottom wall within said inside annular flange;

a socket cap fastened to said socket shell at the bottom, said socket cap comprising an elongated block having two parallel grooves along the length to carry a neutral wire and a hot wire, and two opposite hooks separated by said elongated block and hooked on said bottom flange of said socket shell;

a ring contact fastened inside said socket shell to hold the ring contact of a lamp bulb, said ring contact comprising a notched tip inserted through said first slot and pierced into said neutral wire to make an eletric contact; and a tip contact having one end inserted through said second slot and disposed in contact with the top contact of said lamp bulb, and an opposite end pierced into said hot wire to make an electric contact.

* * * * *